US010436531B2

(12) United States Patent
Lytinas

(10) Patent No.: US 10,436,531 B2
(45) Date of Patent: Oct. 8, 2019

(54) RECOIL APPARATUS FOR FIREARMS

(71) Applicant: Michael Lytinas, Boston, MA (US)

(72) Inventor: Michael Lytinas, Boston, MA (US)

( * ) Notice: Subject to any disclaimer, the term of this patent is extended or adjusted under 35 U.S.C. 154(b) by 0 days.

(21) Appl. No.: 16/044,200

(22) Filed: Jul. 24, 2018

(65) Prior Publication Data

US 2019/0033021 A1 Jan. 31, 2019

Related U.S. Application Data

(63) Continuation-in-part of application No. 15/618,111, filed on Jun. 8, 2017, now Pat. No. 10,082,351.

(60) Provisional application No. 62/347,124, filed on Jun. 8, 2016.

(51) Int. Cl.

| | |
|---|---|
| ***F41A 3/86*** | (2006.01) |
| ***F41A 3/40*** | (2006.01) |
| ***F41A 19/30*** | (2006.01) |
| ***F41A 3/54*** | (2006.01) |

(52) U.S. Cl.

CPC ..... *F41A 3/86* (2013.01); *F41A 3/40* (2013.01); *F41A 3/54* (2013.01); *F41A 19/30* (2013.01)

(58) Field of Classification Search

CPC ..... F41A 3/86; F41A 3/40; F41A 3/54; F41A 19/30

USPC ..... 89/156, 158, 166, 176, 183, 199

See application file for complete search history.

(56) References Cited

U.S. PATENT DOCUMENTS

| | | | | | |
|---|---|---|---|---|---|
| 642,018 | A * | 1/1900 | Ternstrom | F41A 5/08 | 42/25 |
| 830,511 | A * | 9/1906 | Lehmann | F41A 3/40 | 89/149 |
| 1,344,499 | A * | 6/1920 | Gabbett-Fairfax | F41A 5/00 | 89/14.3 |
| 1,451,443 | A * | 4/1923 | Fowler | F41A 3/38 | 42/16 |
| 2,744,448 | A * | 5/1956 | Allen | F41A 3/54 | 42/69.03 |
| 3,757,636 | A * | 9/1973 | Chiabrandy | F41A 3/82 | 89/169 |
| 10,082,351 | B2 * | 9/2018 | Lytinas | F41A 3/86 | |
| 2017/0356705 | A1 * | 12/2017 | Lytinas | F41A 19/30 | |
| 2019/0033021 | A1 * | 1/2019 | Lytinas | F41A 3/86 | |

* cited by examiner

*Primary Examiner* — Samir Abdosh

(74) *Attorney, Agent, or Firm* — Notaro, Michalos & Zaccaria P.C.

(57) ABSTRACT

A recoil inversion assembly for firearms having frame, barrel for a cartridge, bolt movable during a firing cycle, firing mechanism for firing the cartridge and recoil rod with recoil spring. The recoil inversion assembly has a transfer arm with one end pivotally connected to the bolt at a bolt axis, a guide slot in the frame for slidably receiving the bolt axis as the bolt moves during a firing cycle, an inversion lever having one end pivotally connected to the opposite end of the transfer arm, a fulcrum engaged with the inversion lever for rotation of the inversion arm with respect to the frame and recoil force transmitting mechanism connected to the inversion lever for transmitting rotation of the inversion level to the recoil spring for compressing the spring such that blowback during a firing cycle is transferred through the recoil inversion assembly to the recoil spring.

11 Claims, 11 Drawing Sheets

RECOIL APPARATUS FOR FIREARMS

CROSS-REFERENCE TO RELATED APPLICATIONS

This is a continuation-in-part of application Ser. No. 15/618,111 filed Jun. 8, 2017, which claims priority on provisional patent application No. 62/347,124 filed Jun. 8, 2016, which priority claim is repeated here and both of which applications are incorporated therein by reference.

FIELD AND BACKGROUND OF THE INVENTION

The present invention relates generally to the field of firearms, and in particular to a new and useful recoil inversion assembly for improving the recoil characteristics of a firearm of the auto-loading type, whether it be a handgun, a carbine or a long rifle, and of the semi-automatic or fully automatic variety.

Recoil and muzzle redirection, such as muzzle flip and muzzle climb, are significant factors affecting the effective use and accuracy of firearms.

A need remains for improvements in mechanisms for controlling recoil in auto-loading firearms, including semi-automatic and automatic firearms.

SUMMARY OF THE INVENTION

It is an object of the present invention to provide a recoil inversion assembly for a firearm having a frame, a barrel with a breach end for a cartridge, a bolt movable due to blowback away from the breach end of the barrel during a firing cycle, a firing mechanism for firing the cartridge, and a recoil rod with recoil spring for moving the bolt toward the breach end of the barrel at an end of a firing cycle.

According to the invention, the recoil inversion assembly has a transfer arm with one end pivotally connected to the bolt at a bolt axis, and an opposite end, a guide slot in the frame for slidably receiving the bolt axis as the bolt moves during a firing cycle, an inversion lever having one end pivotally connected to the opposite end of the transfer arm, a fulcrum engaged with the inversion lever for rotation of the inversion arm with respect to the frame, a slider for sliding a junction between the transfer arm and the inversion lever downwardly during the first few milliseconds of a firing cycle and recoil force transmitting means connected to the inversion lever for transmitting rotation of the inversion level to the recoil spring for compressing the recoil spring, such that blowback during a firing cycle is transferred through the recoil inversion assembly to the recoil spring.

According to a first embodiment of the invention, the recoil force transmitting means comprises the fulcrum being connected to an opposite end of the inversion lever and including a pinion rotatable with rotation of the inversion lever, a rack connected to a rear end of the recoil rod and including teeth meshed with the pinion for moving the rack and recoil rod forwardly when the pinion rotates during a beginning of a firing cycle, and a stop in the frame for holding a forward end of the recoil spring, the rack being engaged with an opposite end of the recoil spring for compressing the recoil spring when the rack moves forwardly in the frame.

According to a second embodiment of the invention, the recoil force transmitting means comprises the fulcrum being fixed to the frame and being intermediate the ends of the inversion lever, an opposite end of the inversion lever from the first-mentioned transfer arm being connected to a second transfer arm that is engaged with the recoil spring for compressing the recoil spring during a beginning of a firing cycle.

The invention improves the manageability of firearms by reducing the recoil generated from the expanding gases from the cartridge and minimizing muzzle climb and muzzle flip. It does that by inverting the recoil from the shooter to the front of the firearm, thus balancing out the recoil force. This is particularly important in the case of handguns, especially in high powered calibers, such as 10 mm.

Accordingly, one aspect of the invention provides a recoil inversion assembly designed with an inversion construct. The inversion construct comprises an inversion lever and a fulcrum, wherein the inversion lever is linked on one end to a set of transfer-locking arms through a pivot pin. The blowback energy of the expanding gases from the cartridge when fired, is transferred through the transfer-locking arms to the inversion lever, which pivots and transfers this energy to a recoil spring through gears, e.g. a rack and pinion combination, to the recoil rod.

Another aspect of the present invention provides for the mechanism of operation of the firearm which falls under the "delayed blowback" category. The bolt of the firearm is locked toward the barrel breach end with the transfer-locking arms. The bolt incorporates a firing pin that strikes the primer of the cartridge in order to detonate the charge in the cartridge. After the detonation, the empty cartridge pushes the bolt to the rear of the firearm, towards the shooter. However, the bolt is momentarily locked to the barrel with the transfer-locking arms, via the bolt axis. The transfer-locking arms, in order to move and unlock the breech, have to slide on one or two inclined slider surfaces, which are situated inside a cover of the firearm. This sliding of the transfer-locking arms along the inclined surfaces creates the time necessary for the delay of the unlocking of the breech, thus creating the "delayed blowback" mechanism of operation.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which two embodiments of the invention are illustrated.

DESCRIPTION OF THE PREFERRED EMBODIMENTS

Figure 1:
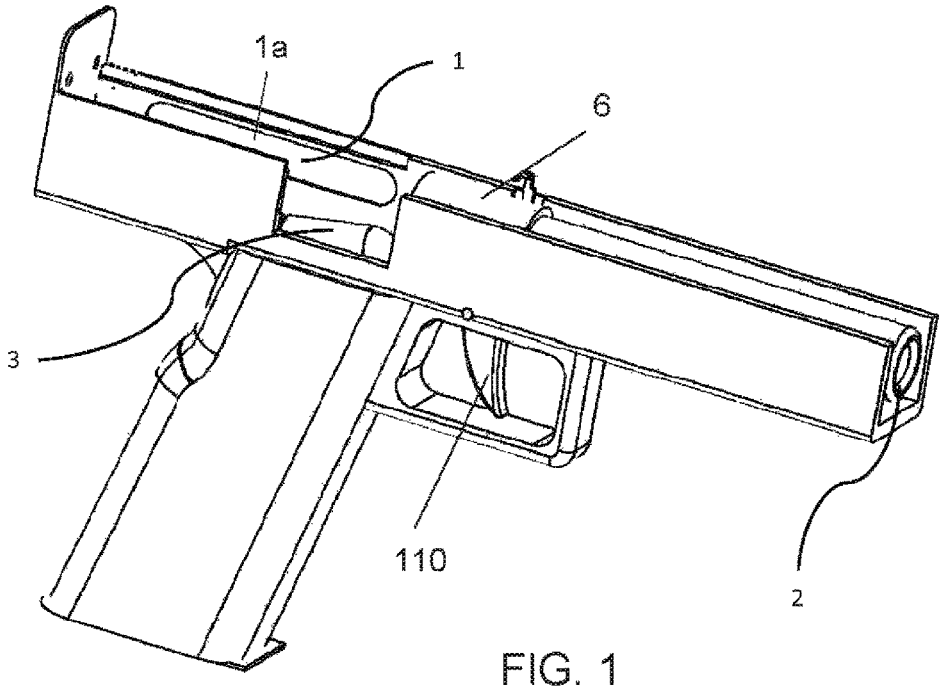
FIG. 1 is a perspective view of a firearm in the form of a handgun, with its normally fixed cover removed, and including the mechanism of the present invention.
Figure 2:
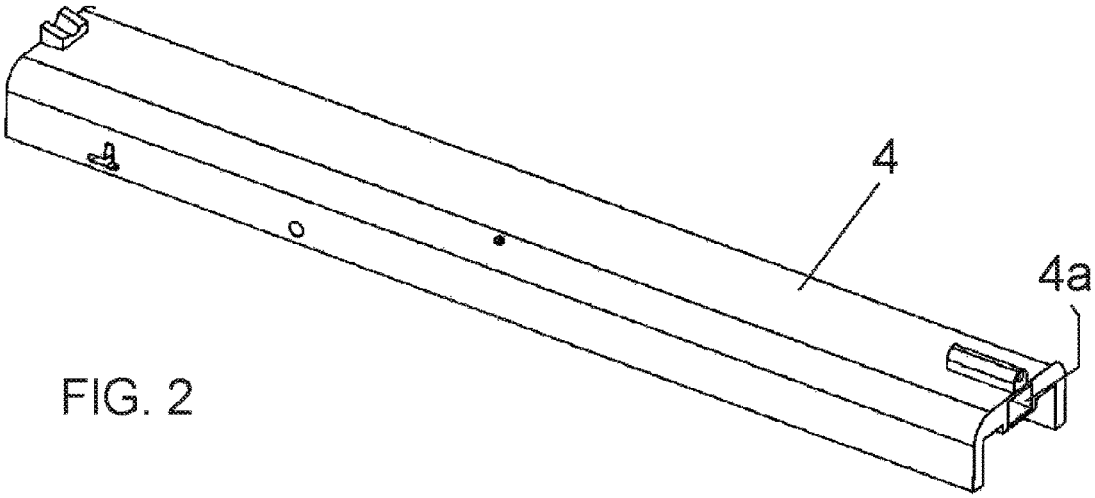
FIG. 2 is a perspective view of the cover that is normally fixed to the top of the handgun.
Figure 3:
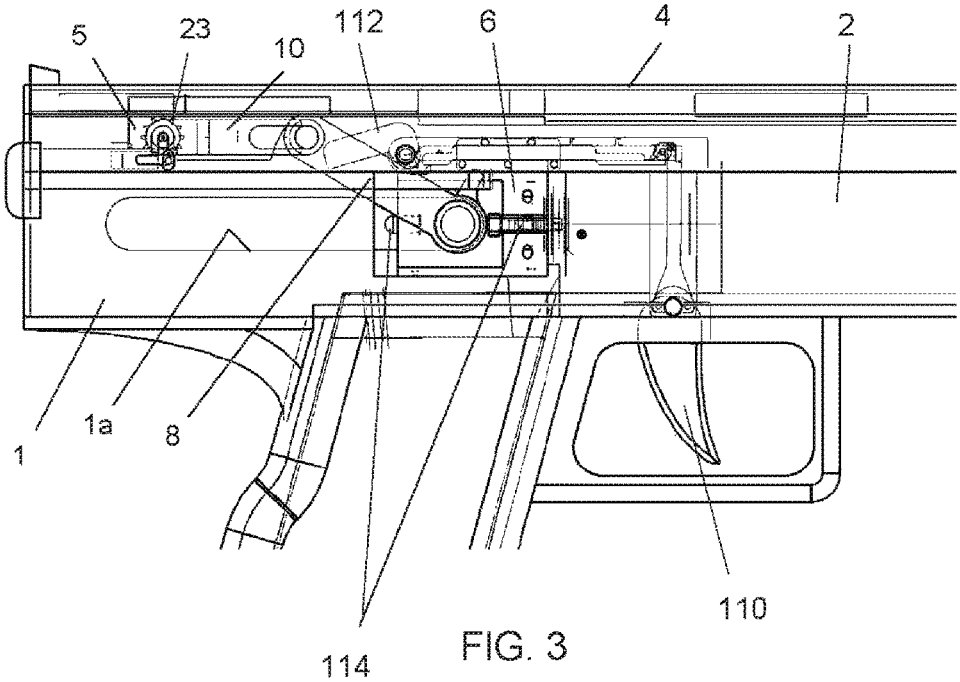
FIG. 3 is a side sectional view of the handgun of FIGS. 1 and 2, with the cover attached and a first embodiment of the invention in an initial position before a cartridge in the barrel breach has been fired, and with all parts of the invention at rest.
Figure 4:
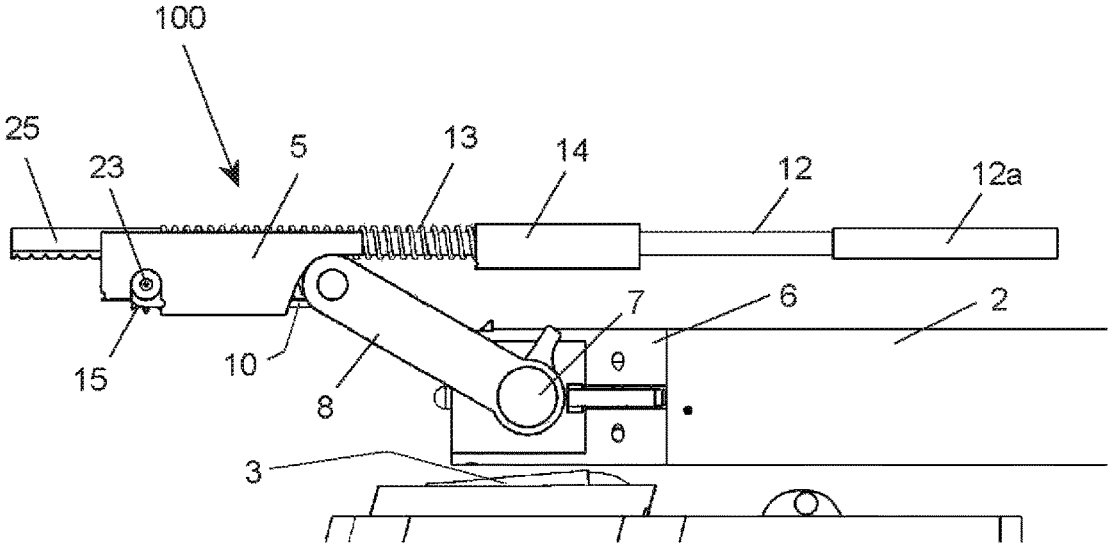
FIG. 4 is a partial side view of the first embodiment of the invention with all parts of the invention at rest before a firing cycle, as in FIG. 3.

Referring now to the drawings, in which like reference numerals are used to refer to the same or similar elements, FIG. 1 shows a recoil inversion assembly for a firearm having a frame 1, a barrel 2 with a breach end for receiving a cartridge 3, a bolt 6 movable due to blowback away from the breach end of the barrel during a firing cycle, and, with reference to FIGS. 3 and 4, a firing mechanism in the form of a trigger 110, a spring-loaded hammer 112 that is released by pulling the trigger and a filing pin or striker 114 that is struck be the falling hammer, for striking the primer in the cartridge for firing the cartridge.

The firearm also includes a recoil rod 12 with recoil spring 13 for moving the bolt 6 back toward the breach end of the barrel at an end of a firing cycle.

The recoil inversion assembly of the invention, in its generic sense, comprises one or preferably two transfer and locking arms 8 having one end pivotally connected to the bolt 6 at a bolt axis 7. A guide slot or other guide structure 1*a* in the frame 1 is provided for slidably receiving and guiding the linear rearward and forward movement of the bolt axis 7 as the bolt 6 moves during a firing cycle. An inversion lever 10 has one end pivotally connected to the opposite end of the transfer arm 8. A fulcrum 23 engaged with the inversion lever 10 is for rotation of the inversion lever 10 with respect to the frame 1, and recoil force transmitting means 100 are connected to the inversion lever 10 for transmitting rotation of the inversion level to the recoil spring 13 for compressing the recoil spring 13, such that blowback during a firing cycle is transferred through the recoil inversion assembly to the recoil spring 13.

The transfer arm or arms 8 are also called transfer and locking or T-L arms due to their dual purpose. These arms, inversion lever 10 and one or two sliders 5, as well as the second transfer arms and levels of the second embodiment, while expressed in the singular, may include two arms, slides or levers as is preferable in practice as illustrated.

In the embodiment of FIGS. 1 to 17, the recoil force transmitting means 100 is constructed with the fulcrum 23 being movable and connected to an opposite end of the inversion lever 10 and including a pinion 15 rotatable with rotation of the inversion lever 10, a rack 25 connected to a rear end of the recoil rod 12, the rack including teeth meshed with teeth of the pinion 15 for moving the rack and recoil rod forwardly when the pinion rotates during the initial phase of a firing cycle, and a stop 4 is fixed in the frame 1 for holding a forward end of the recoil spring 13, the rack being engaged with an opposite end of the recoil spring for compressing the recoil spring when the rack moves forwardly in the frame.

Figure 18:
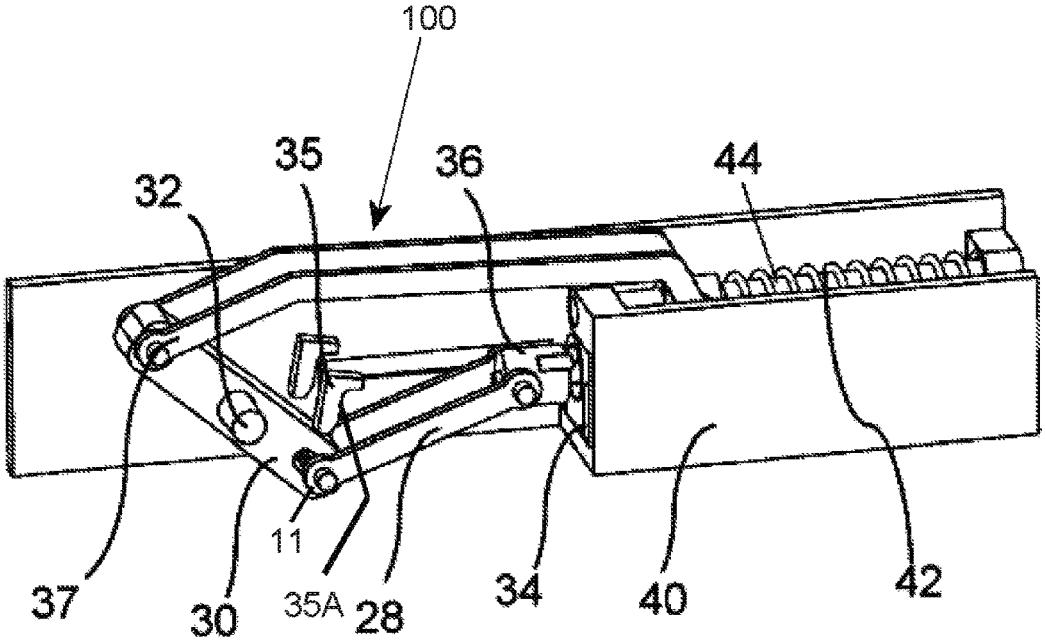
FIG. 18 is a perspective view of the second embodiment of the invention showing a second embodiment of the recoil force transmitting means.

In the second embodiment of FIG. 18 and as also more fully disclosed in the here incorporated parent patent application Ser. No. 15/618,111, the recoil force transmitting means 100 is constructed with the fulcrum 32 being fixed to the firearm frame 40, and being intermediate the ends of an inversion lever 30, an opposite end of the inversion lever from the first-mentioned transfer arm 28, being connected to a second transfer arm 37 that is engaged with the recoil spring 44 for compressing the recoil spring along a fixed recoil rod 42 during a firing cycle. First-mentioned transfer arms 28 are pivotally connected to the bolt 36 that is locked against the breach of barrel 34 before a firing cycle begins. The transfer arms 28 also act as locking arms before and during the first few milliseconds after a firing cycle has started.

FIG. 18 shows the position of the parts milliseconds after the trigger mechanism has fired the cartridge. At this time a spring loaded pivot function journal 11, that forms the pivot connection between the transfer arm or arms 28 and the lever 30, has slide down a concave slide surface 35*a* of a slider 35 that is fixed in the frame 40. This motion is caused by the rearward force impulse at the starting phase of the firing cycle, due to the expanding gases and the movement of the bullet down the barrel, but before the bolt 36 moves from the breach end of the barrel 34. This is because the bolt is locked in place until the junction 11 slides down surface 35*a*. This motion is permitted because the spring loaded pivot junction 11 allows the transfer arms 28 to move rearwardly a small amount with respect to the inversion lever 30, that in turn allows the pivot junction 11 to slide down the slider 35.

Figure 15:
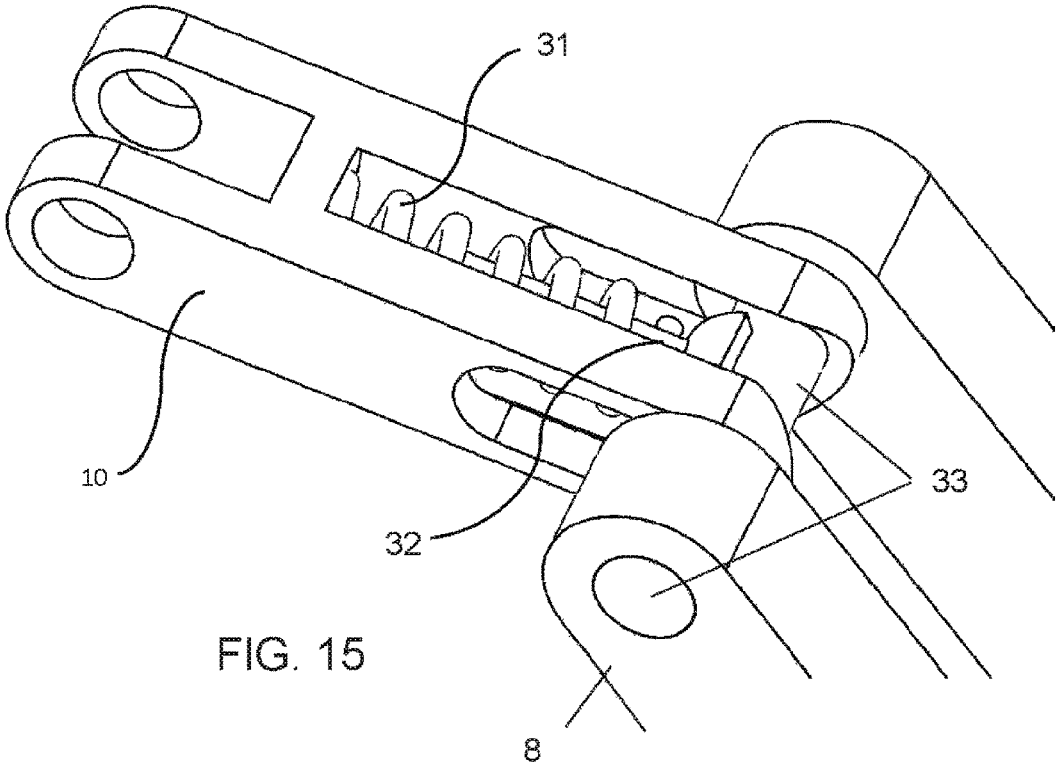
FIG. 15 is an enlarged perspective view of the inversion lever of the invention with its connection to the transfer and locking arm of the recoil force transmitting means, of the first and the second embodiments of the invention.

The spring loaded pivot journal 11 has the same construction in the first and the second embodiments, and is shown in greater detail in FIG. 15 as it related to the first embodiment.

After that initial phase, the bold 36 is released to move rearwardly, the lever 30 pivots clock-wise pushed the second transfer arms 37 forwardly to compress the recoil spring 44 on the recoil rod 42.

The Firing Process—A Guided Explosion

What does Firing a Cartridge Mean?

The firing process of a cartridge through a weapon is a controlled explosion. The detonation of the primer which leads to the ignition of the gun powder of the cartridge, which eventually pushes the projectile (bullet) out of the barrel must be precisely controlled in order to be effective. That is the role of the weapon, to control this process as accurately as possible. The barrel, the bolt and the breech of the gun are the key components for this process.

What is the Role of the Barrel?

The role of the barrel is to support the walls of the cartridge so that they don't rupture after the detonation of its gun powder. If there is no barrel to do so, the cartridge will explode and the bullet will not reach its target. With the barrel in place, the walls of the cartridge are supported and this controlled detonation will guide all the explosion gases to push the bullet out of the barrel.

What is the Role of the Bolt?

The bolt supports the base of the cartridge and secures it into the firing chamber. Due to the "action-reaction" principle, the energy of the exploding gases would push the empty cartridge back during firing. This is prevented by the bolt which never moves during the explosion of the gun powder, thus securing that the cartridge stays in place. By doing so, all the energy of the exploding gases will be directed to push the bullet out of the barrel.

What is the Role of the Breech?

The bolt of the weapon and the back part of the barrel—where the firing chamber is situated—create a space which is called the breech of the weapon. Initially, the term "breech of a gun" was created to distinguish between the muzzle loading and the breech loading guns. The breech must be closed during firing so that the bolt and the barrel remain connected during the firing process. This is important because the exploding gases must reach a safe (lower) level of pressure before the extraction of the empty cartridge begins. If the pressure inside the barrel is still high when the extraction begins, the empty cartridge will be destroyed.

What is the Firing Cycle?

After the detonation of the cartridge, the bullet is exiting the muzzle in a very short period of time. During this time the breech is closed to facilitate the lowering of the pressure inside the barrel. After the bullet exits the muzzle, said pressure begins to lower, up to the point where it is safe for the extraction of the empty cartridge to begin. Then, the extractor pulls the empty cartridge out of the barrel and the ejector pushes it out of the gun. After that, the bolt pushes a fresh round into the chamber and the firing cycle starts over. There are several mechanisms of operations to control this firing cycle. One such mechanism of operation is called "delayed blowback". This is the mechanism of operation that this invention is based on.

What is the Recoil of a Firearm?

The energy of the exploding gases pushes the bullet out of the gun and at the same time pushes the gun back to the shooter, obeying the "action-reaction" principle. This movement of the whole gun back to the shooter (or the shooting base of a weapon) is called recoil of the gun. Said recoil can vary in intensity from mild to very strong, making the gun pleasant to shoot or not. A pleasant to shoot gun is a gun that is both accurate and easier to acquire the target. The design of the gun and its operating mechanism are key factors on how the shooter perceives the recoil of a gun. As an example, a bolt action gun has significantly more recoil than a gas gun of the same caliber. The reason for that is that all the energy from the firing is transferred to the shooter who accepts this movement and has to support it. In a gas gun, part of the recoil is spent to cycle the gun and a lower recoil is transferred to the shooter, thusly making the gun more pleasant to shoot. In some cases, the recoil of a gun is so excessive that makes the gun suitable for only a few, very well-trained people. This technology deals with said excessive recoil force by redirecting it away from the shooter. By doing so, this technology makes high-caliber guns to have a lower caliber gun recoil, thus making them more pleasant to shoot and more accurate.

Key Features of the Inventive Technology.

The redirection of the recoil from the shooter to the muzzle of the gun is the core of this technology and it is called the "inversion of the recoil". The bolt, after leaving the breech, is transferring the energy to an inversion lever which inverts this energy to the front, the muzzle of the gun, away from the shooter. An added benefit of this inversion is the virtual elimination of the muzzle flip during firing.

The Inventive Technology in Detail.

The bolt contains the firing pin, which impacts the primer of the cartridge to detonate it. The gun powder is then ignited and the propellant gases from the explosion push the projectile out of the gun. At this moment the bolt is pushed back from the exploding cartridge (action-reaction). However, the bolt cannot move back because it is locked to the breech with the T-L arms. These arms accept the energy from the bolt and they have to slide on the two sliders. These two arms and the sliders are arranged in such a way that the bolt must act through a tremendous mechanical disadvantage to overcome the recoil force and is thusly subjected to a very high resistance to motion. This is what constitutes the mechanism of operation of this gun as "delayed blowback". This delay is needed to create the time for the pressure of the exploding gases to reach a safer level for the extraction. During the sliding of the transfer locking or T-L arms on the sliders, the bolt remains locked to the breech.

After said sliding, it is the inversion lever's turn to accept the energy. This inversion lever converts the linear (up to that point) recoil force to angular. This makes the inversion lever to rotate on its axis. Said rotation of the inversion lever sets in motion the pinion. Said pinion has the same axis with the inversion lever and the angular motion of the inversion lever is converted back to linear on the pinion. The pinion is connected to the rack, which is part of the recoil rod. This way, the pinion transfers the energy to the front of the gun, thus "inversion of the recoil". The recoil rod is actuated by the recoil spring and acts against said motion. Said recoil spring stops at the recoil spring stopper which is part of the cover of the gun and is immobile. Meanwhile, the bolt (through the T-L arms and the inversion lever) has reached its final point at the back of the gun and (through the recoil spring/rod and through the rack/pinion) starts to move to the front of the gun to insert a fresh round in the chamber. This completes the cycle.

Through the firing cycle, a big part of the recoil energy is "bled away" to the mechanism of the gun. The sliding of the arms on the sliders, the conversion of the linear to angular motion on the inversion lever, the conversion back to linear motion in the rack and pinion assembly and the recoil rod pushing the recoil spring, all these steps create a mechanical disadvantage for the recoil to overcome. As a result, each and every step lowers the recoil.

Additionally, the bolt of the gun never comes to an abrupt stop and it never hits the frame of the gun. Especially in pistols, this abrupt stop of the slide creates the perceived recoil to the shooter. In this technology, the bolt slides in its tracks inside the frame of the pistol and it stops without ever hitting the frame. This reciprocating movement of the bolt stops by the inversion lever when the recoil rod reaches the limit of the recoil spring, thus making this reciprocating movement of the bolt smooth.

Another benefit of this technology is that the inversion of the recoil mechanical design makes possible for the barrel to be situated on the "6 o'clock" position, meaning underneath the recoil rod. This arrangement creates a gun with low bore axis. Said low bore axis has the benefit of lowering the rocking of the gun in the hands of the shooter. The existing "tilted barrel" Browning design calls for a reciprocating slide on top of the shooter's hand. This reciprocating movement is translated into a rocking movement (seesaw) of the gun in the hand of the shooter, obeying the lever principle.

The recoil inversion assembly of the invention creates a firearm of the "delayed blowback" category. That means that the bolt must remain closed for the first milliseconds of a shot. During these first milliseconds—and after the bullet has left the muzzle—the pressure inside the barrel is dropping to a safer-lower level.

Figure 6:
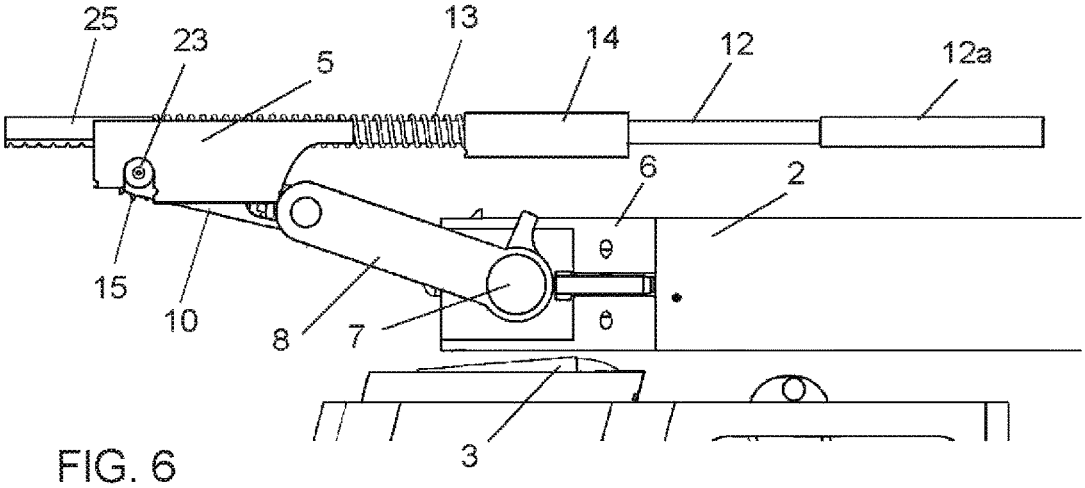
FIG. 6 is a view similar to FIG. 4, shortly after the trigger has been pulled to ignite the charge in the cartridge, but before the bolt has moved, in this position a transfer arm of the invention also acting like a locking arm for momentarily keeping the bold in place with the breach closed long enough, i.e. on the order of a few milliseconds, to allow the bullet to leave the barrel and the pressure of the expanding gases to fall to safe levels.

If the breech opens before this much needed time (the bolt starts to move) then we'll have the premature extraction problem and eruption of the empty cartridge will occur. That is why the bolt does not move during this initial part of the firing cycle. As will be explained in greater detail in connection with the drawings, the small backward movement of the transfer arm 8 during the milliseconds long initial firing cycle period between FIGS. 4 and 6, is caused entirely by the backward impulse of the entire forearm and the compression of inversion lever spring 31 (see FIG. 15) on its inversion lever spring catcher 32 that rotatable bears against the pivot pin connecting the transfer arm 8 to the inversion lever 10.

Bolt 6 transfers the energy of the shot to the arm 8, which they have to slide on the sliders 5 first in order to "unlock" the bolt so that it can move. This is the time needed for the pressure inside the barrel to drop, so that I can have a safer extraction. That is the "delayed" part of the delayed blowback concept.

Another important feature of the invention is the "plasticity" of the sliders 5. This means that we can give whatever angle we want to the sliders so that the arms slide easier or not, the breech opens earlier or later, all adaptable to the caliber.

Returning to FIGS. 1 to 3, the invention if illustrated in the form of a delayed blowback operated handgun incorporating the recoil inversion technology of the invention. The barrel of the handgun is situated at the "6 o'clock" position when viewed from the front, i.e. underneath the recoil rod 12 and spring 13. This feature adds the benefit of the low bore axis, which translates to even less felt recoil. The reason is that the recoil force is directed straight back to the hand of the shooter. A prevalent design of pistols such as the Browning "tilting barrel" design, incorporates a reciprocating heavy steel slide. This slide reciprocates on top of the shooter's hand creating a seesaw-like movement. This is what causes muzzle flip, which leads to decreased accuracy and slower target acquisition. The cover 4 in the handgun of the invention is fixed and does not slide. Rather, the inversion recoil mechanism of the invention moves under the cover.

The body of the firearm incorporates the barrel 2 which is fixed to the frame or body 1 of the firearm. Fixed barrels are more accurate by default because they are immobile. The slightest movement of the barrel will skew the accuracy by a lot down range, as it is in the Browning "tilting barrel" design.

Figure 17:
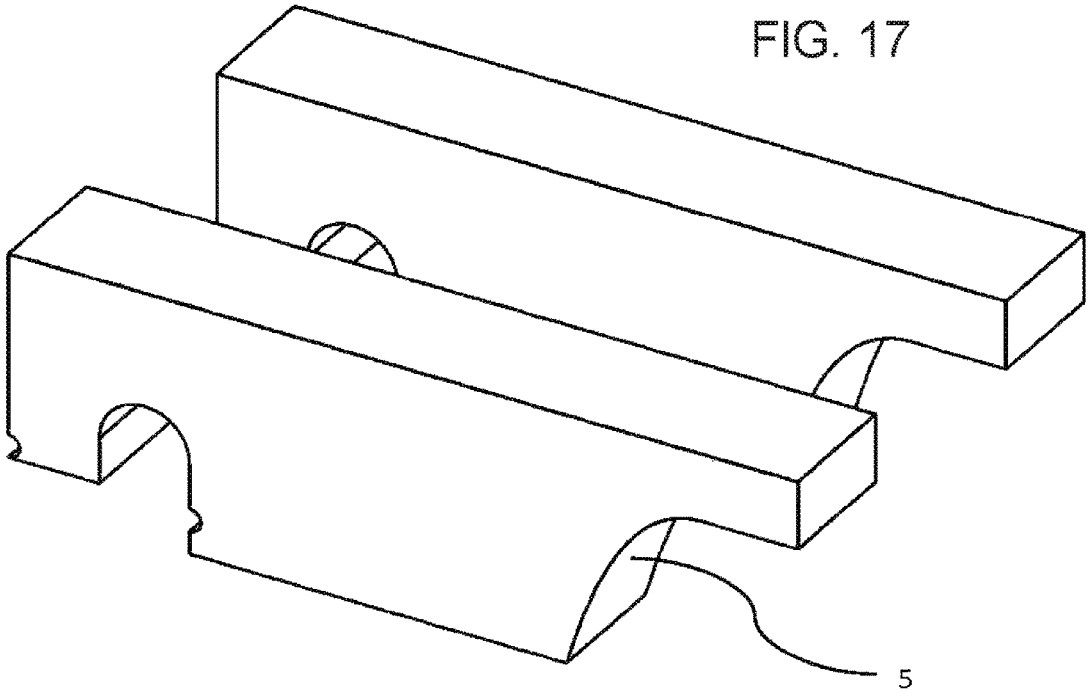
FIG. 17 is an enlarged perspective view of the sliders of the recoil force transmitting means of the first embodiment.

Transfer-Locking Arms Lock and Transfer Motion:

The two inclined surfaces, so called "sliders" 5 (right and left) are also visible in FIGS. 3 and 4 and best shown in FIG. 17. Two sliders 5 are linearly slidably incorporated into the firearm cover 4.

Figure 16:
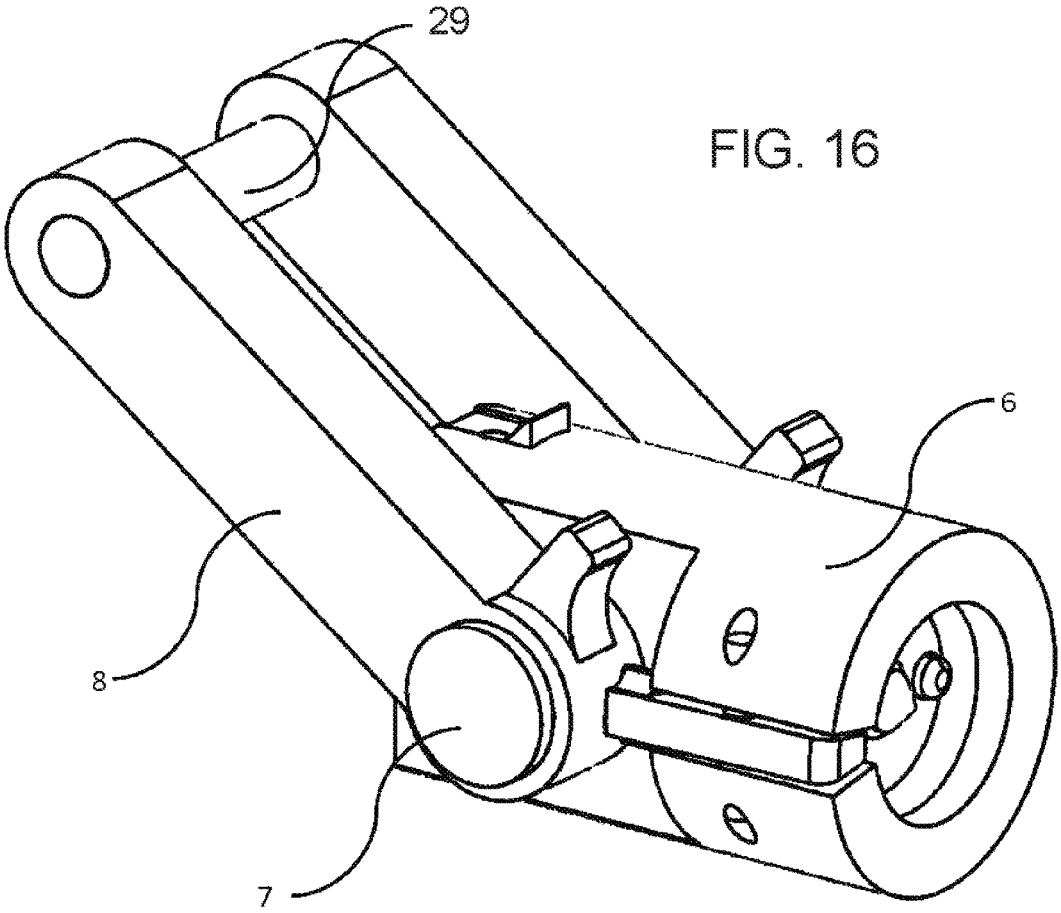
FIG. 16 is an enlarged perspective view of the transfer arm and bolt of the first embodiment.

With reference to FIG. 16, the bolt 6 locked over the breach of the to the barrel as in FIG. 4, with the transfer-locking arm or arms 8 and the arms' rear ends locked against the concave front surfaces of the sliders 5, also seen in FIG. 4, the action is ready to move upon firing of the firearm. After the initial milliseconds period, and in the sequence of FIGS. 6 to 10, the T-L arms 8 convert the linear motion of the bolt 6 to angular motion on the sliders 5.

Linear Motion of Bolt Converted to Angular Motion on Sliders:

With reference to FIG. 15, the inversion lever 10 is connected to the T-L arms 8 at a pivot junction that functions to guide them to slide on the concave forward surfaces of the sliders 5. During this phase of the firing cycle, the inversion lever spring 31 works against the T-L arms' movement, creating another way of obstruction to the T-L arms' motion, thus bleeding more recoil energy during the firing cycle. A spring catcher 32 on which spring 31 is carried, bears against the pivot pin 33 of the junction and guides the lever spring 31 as it compresses due to the initial rearward motion arms 8.

Figure 13:
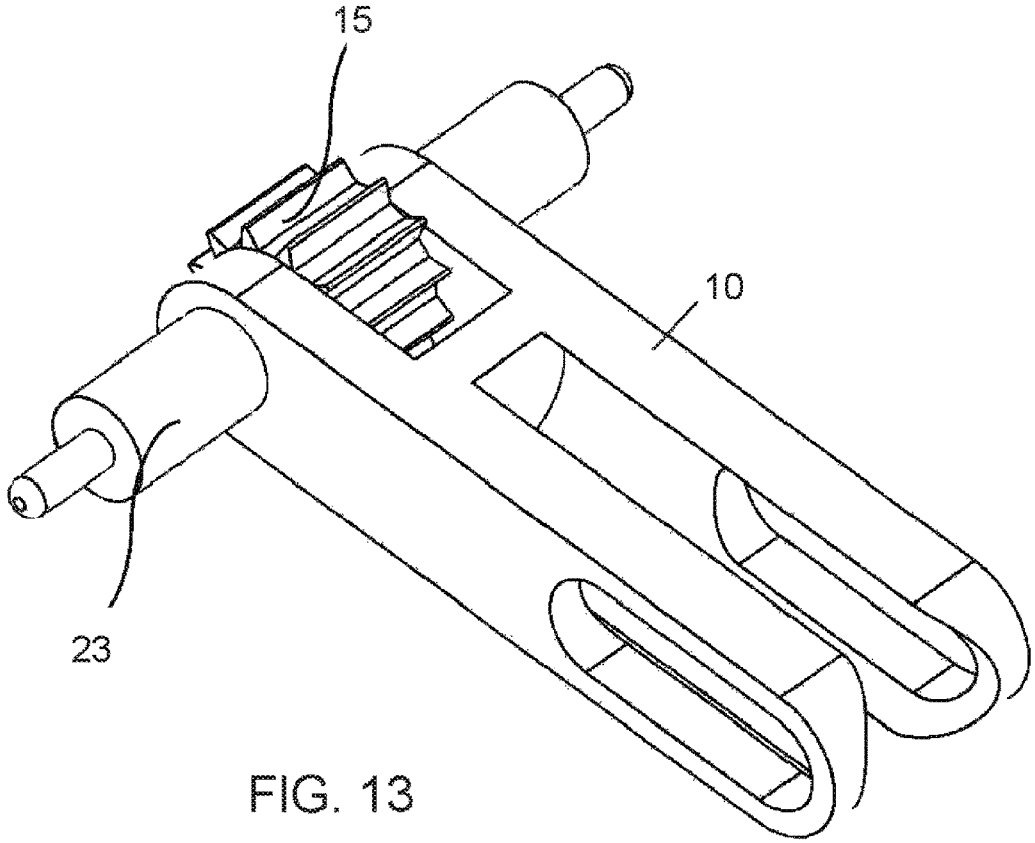
FIG. 13 is an enlarged perspective view of the inversion lever of the invention with fulcrum and pinion of the recoil force transmitting means of the first embodiment.
Figure 14:
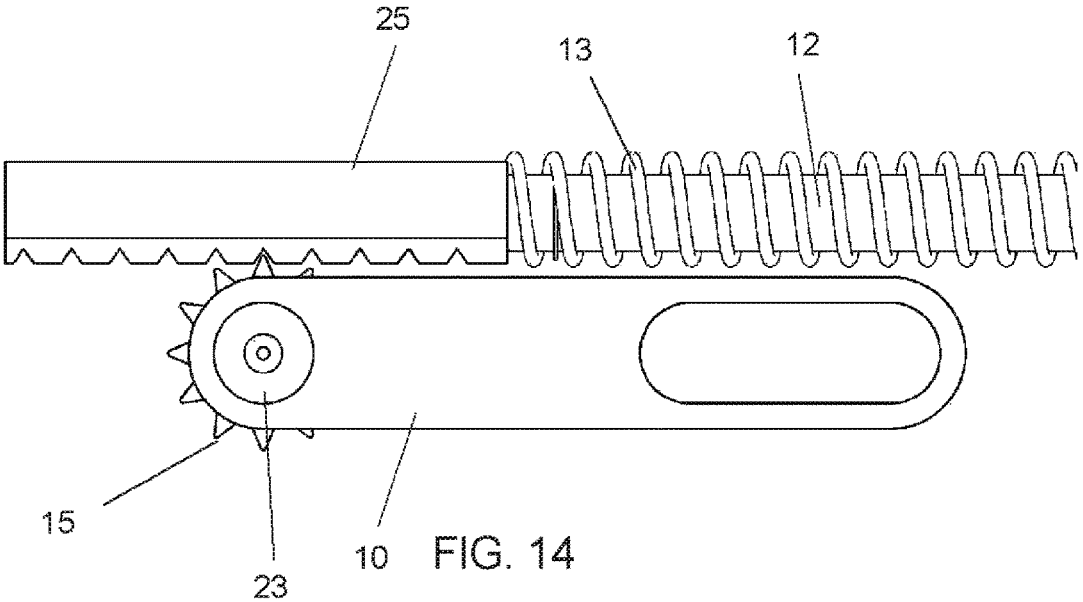
FIG. 14 is an enlarged perspective of the rack and recoil rod and spring with inversion lever, fulcrum and pinion of the first embodiment.

Operation of the Inversion Lever:

With reference to FIGS. 13 and 14, the inversion lever 10 rotates on the fulcrum 23 and transfers the recoil energy through the pinion 15 to the recoil rod via rack 25 that has teeth meshed to the pinion teeth. This will eventually invert the recoil from the shooter to the muzzle. The pinion 15 of the inversion lever mates with the rack 25 of the recoil rod and transfers the recoil energy from the shooter to the muzzle of the weapon.

Figure 5:
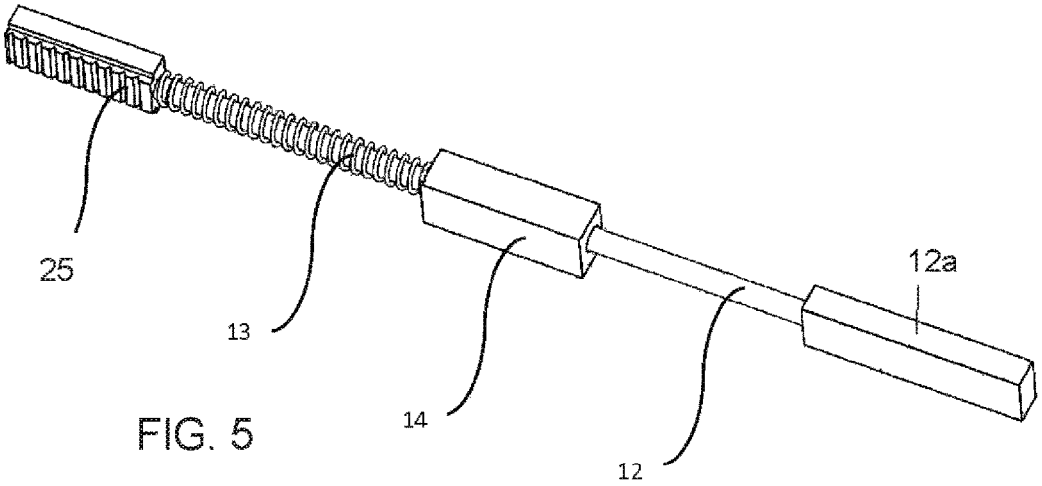
FIG. 5 is a perspective view of the rack, recoil rod, recoil spring, recoil spring stop and a counter weight at the front end of the recoil rod, according to the first embodiment of the invention.

As shown in FIG. 5, there is also an enlarged counter weight **12*a* a the forward end of recoil rod 12 that is rectangular in cross section and is heavier that the rest of the rod, for example by 20 to 50 percent. This rectangular weight section of the rod 12 rides in an aperture of mating shape 4*a* in cover. The advantage of this heavier forward end of the rod 12** is that as the rod moves forwardly during a firing cycle, this extra weight help counteract the usual upward movement or muzzle climb of a handgun of other firearm, by shifting more weigh to the front of the firearm.

Details of Action Sequence During a Firing Cycle:

Starting with FIG. 4, the mechanism of the invention and firearm is ready to fire.

At FIG. 6, upon firing, the bolt 6 obeying the "action-reaction" principle and starts to move to the back. However, it can move only after the T-L arms 8 have finished sliding on the sliders 5, as the figure shows where the rear curved surfaces of the arms 8 are about finished sliding down on the convex forward surfaces of sliders 5. Throughout their sliding, the bolt 6 remains locked on the barrel 2, and this is important for safety reasons as noted above.

Figure 7:
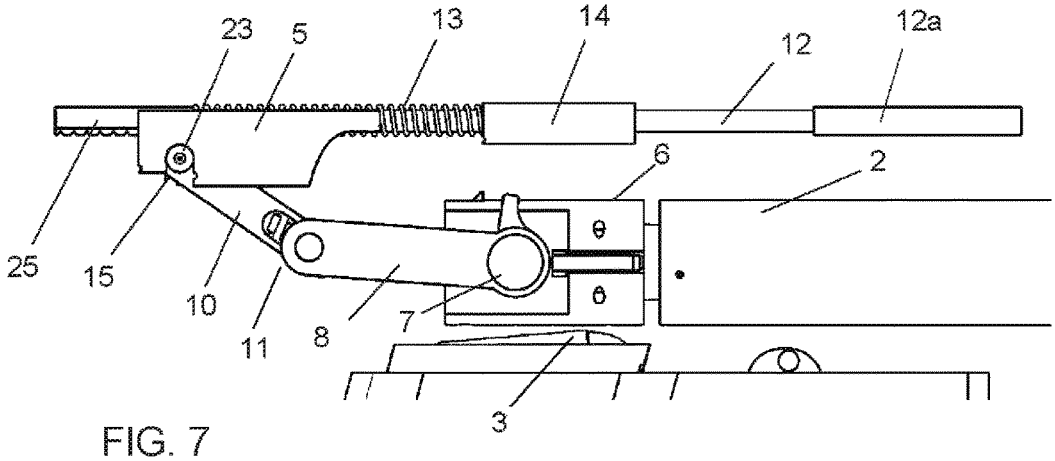
FIG. 7 is a view similar to FIG. 6, an instant later, as the transfer arm and inversion lever of the invention toggle downwardly and the bold begins to move rearwardly during the firing cycle.

In FIG. 7, after arms 8 leave the lower edges of sliders 5, the bolt 6 is free to move to the rear, thus starting the unlocking of the bolt-barrel combination. At this point the pressure of the gases inside the barrel are at a safe level. This is particularly important for the safe extraction of the empty cartridge.

Figure 8:
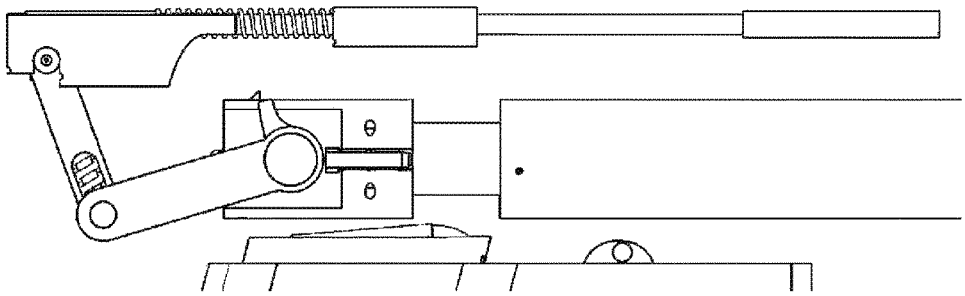
FIG. 8, FIG. 9, FIG. 10, FIG. 11 and FIG. 12 are views like FIGS. 4, 6 and 7, in sequence, showing the position of the recoil inversion assembly of the invention, from instant to instant during a firing cycle, with the final instant being the same as FIG. 4 with all parts in the rest condition in preparation for the next cycle.

In FIG. 8, the bolt 6 continuing its linear motion towards the back of the firearm. The empty cartridge is about to be extracted. Meanwhile, the recoil rod 12 is moving towardly of the muzzle of the barrel, all the while working against the recoil rod spring 13 that si being compressed.

Figure 9:
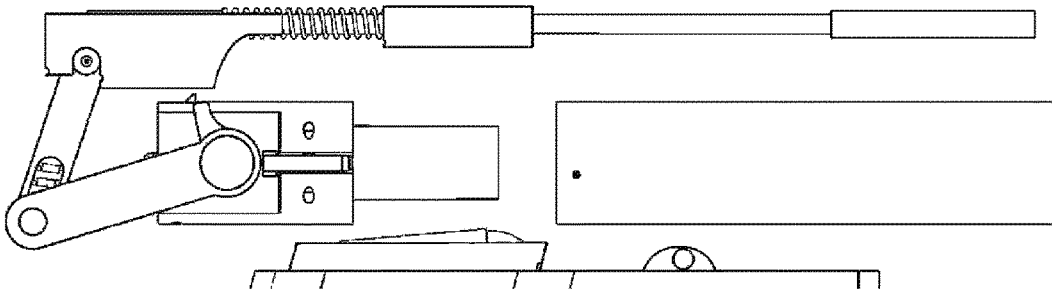
Figure 10:
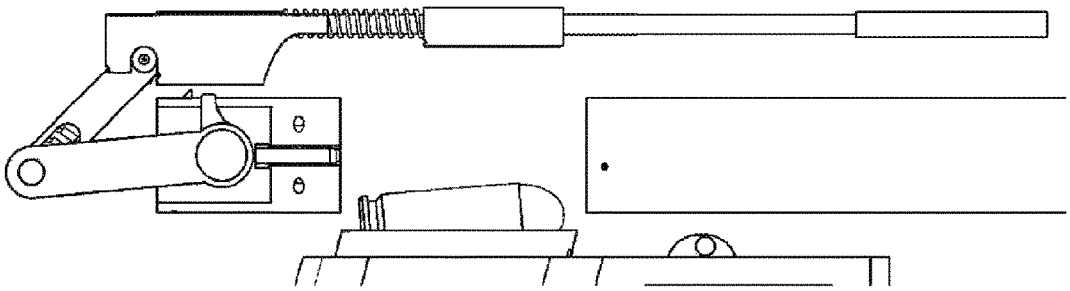

FIG. 9, the cartridge is about to be extracted. The bolt 6 keeps on moving towards the back and the compressed recoil spring 13 works against this bolt movement. FIG. 10, the bolt 6 is at the rear end of its travel. The bolt never hits the frame in order to stop, which is the principal cause for excess felt recoil. The empty cartridge is ejected and a fresh one is waiting to be loaded in the chamber.

Figure 11:
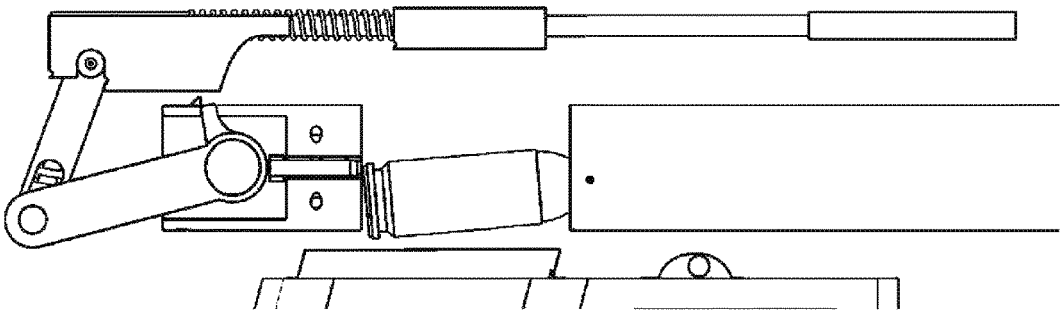
Figure 12:
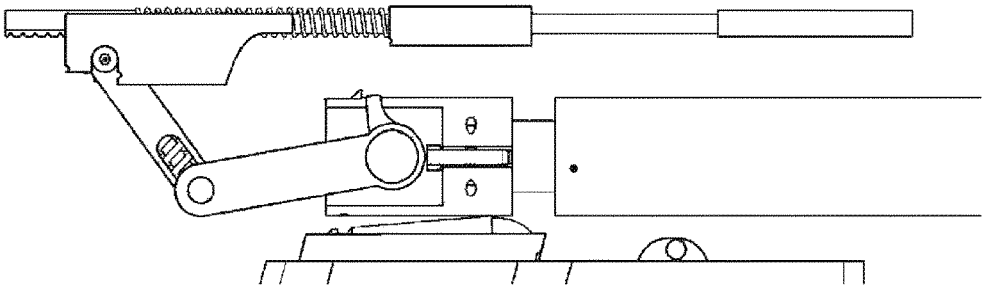

FIG. 11, a fresh round is about to enter the beach chamber of the barrel. The recoil spring 13 pushes the inversion lever 10 through the rack and pinion, back toward the start a new firing cycle. FIG. 12, a new firing cycle is about to begin, the fresh round almost inside the chamber then back to the position of FIG. 4 where the firearm is ready to fire again. The bolt is locked to the barrel and the T-L arms are locked to the sliders.

The second embodiment of FIG. 18 differs from the embodiment of FIGS. 1 to 17 in the treatment of the motion at the rear end of the inversion lever 10 in the first embodiment and 30 in the second, but the advantageous dynamics are the same.

The second embodiment operates the same way as the first to invert the recoil from the shooter to the muzzle of the firearm. However, in the case of a handgun, where space is limited, the first embodiment is preferred for transferring the energy from the fulcrum to the muzzle. The second embodiment uses the second transfer arms 37 while the first embodiment uses the rack and pinion system. They are both doing the same job, that is to say convert angular motion to linear. The angular motion of the fulcrum is converted to the linear motion of the recoil rod in both models.

While a specific embodiment of the invention has been shown and described in detail to illustrate the application of the principles of the invention, it will be understood that the invention may be embodied otherwise without departing from such principles.

What is claimed is:

1. A recoil inversion assembly for a firearm having a frame (1, 40), a barrel (2, 34) with a breach end for a cartridge (3), a bolt (6, 36) movable due to blowback away from the breach end of the barrel during a firing cycle, a firing mechanism (110, 112, 114) for firing the cartridge, and a recoil rod (12, 42) with recoil spring (13, 44) for moving the bolt toward the breach end of the barrel at an end of a firing cycle, the recoil inversion assembly comprising:

a transfer arm (8, 28) having one end pivotally connected to the bolt (6, 36) at a bolt axis (7), and an opposite end;

a guide (1*a*) in the frame (1, 40) for slidably receiving the bolt axis (7) to move the bolt axis as the bolt (6, 36) moves during a firing cycle;

an inversion lever (10, 30) having one end pivotally connected at a pivot junction (11) to the opposite end of the transfer arm (8, 28);

a fulcrum (23, 32) engaged with the inversion lever (10, 30) for rotation of the inversion lever (10, 30) with respect to the frame (1, 40);

a slider (5, 35) having a slider surface against which the pivot journal (11) is engaged before a firing cycle begins for locking the bolt against the breach end of the barrel during an initial phase of a firing cycle, the pivot journal (11) sliding along the slide surface during the initial phase until the pivot journal (11) slides off the slider surface to allow rearward movement of the bolt; and recoil force transmitting means (100) connected to the inversion lever (10) for transmitting rotation of the inversion level to the recoil spring (13) for compressing the recoil spring (13), such that blowback during a firing cycle is transferred through the recoil inversion assembly to the recoil spring.

2. The recoil inversion assembly of claim 1, wherein the slider surface is concave.

3. The recoil inversion assembly of claim 1, wherein the slider surface is concave, the pivot journal (11) comprising a inversion lever spring (31) captured in the inversion lever for biasing the inversion lever away from the transfer arm (8, 28).

4. The recoil inversion assembly of claim 1, wherein the recoil force transmitting means (100) comprises the fulcrum (23) being connected to an opposite end of the inversion lever (10) and including a pinion (15) rotatable with rotation of the inversion lever (10), a rack (25) connected to a rear end of the recoil rod (12), the rack including teeth meshed with the pinion (15) for moving the rack and recoil rod forwardly when the pinion rotates during a beginning of a firing cycle, and a stop (4) in the frame for holding a forward end of the recoil spring (13), the rack being engaged with an opposite end of the recoil spring for compressing the recoil spring when the rack moves forwardly in the frame.

5. The recoil inversion assembly of claim 1, wherein the recoil force transmitting means (100) comprises the fulcrum (23) being connected to an opposite end of the inversion lever (10) and including a pinion (15) rotatable with rotation of the inversion lever (10), a rack (25) connected to a rear end of the recoil rod (12), the rack including teeth meshed with the pinion (15) for moving the rack and recoil rod forwardly when the pinion rotates during a beginning of a firing cycle, a stop (4) in the frame for holding a forward end of the recoil spring (13), the rack being engaged with an opposite end of the recoil spring for compressing the recoil spring when the rack moves forwardly in the frame, the slider surface being a concave forward surface of the slider against which a rear end of the transfer arm (8) forming part of the pivot journal (11) slides to move the pivot journal (11) downwardly.

6. The recoil inversion assembly of claim 1, wherein the recoil force transmitting means (100) comprises the fulcrum (23) being connected to an opposite end of the inversion lever (10) and including a pinion (15) rotatable with rotation of the inversion lever (10), a rack (25) connected to a rear end of the recoil rod (12), the rack including teeth meshed with the pinion (15) for moving the rack and recoil rod forwardly when the pinion rotates during a beginning of a firing cycle, and a stop (4) in the frame for holding a forward end of the recoil spring (13), the rack being engaged with an opposite end of the recoil spring for compressing the recoil spring when the rack moves forwardly in the frame, and a counter weight (12*a*) at a forward end of recoil rod (12) for transferring weight forwardly during a firing cycle.

7. The recoil inversion assembly of claim 1, wherein the recoil force transmitting means (100) comprises the fulcrum (23) being connected to an opposite end of the inversion lever (10) and including a pinion (15) rotatable with rotation of the inversion lever (10), a rack (25) connected to a rear end of the recoil rod (12), the rack including teeth meshed with the pinion (15) for moving the rack and recoil rod forwardly when the pinion rotates during a beginning of a firing cycle, and a stop (4) in the frame for holding a forward end of the recoil spring (13), the rack being engaged with an opposite end of the recoil spring for compressing the recoil spring when the rack moves forwardly in the frame, and a counter weight (12*a*) at a forward end of recoil rod (12) for transferring weight forwardly during a firing cycle, a cover (4) on the firearm frame for covering the slider, the recoil spring and the recoil rod, the cover including an aperture (4*a*) for slidably receiving the counter weight.

8. The recoil inversion assembly of claim 1, wherein the slider surface (35*a*) is concave and the slider (35) is fixed in the frame (40).

9. The recoil inversion assembly of claim 1, wherein the recoil force transmitting means comprises the fulcrum (32)

and the slider (35) being fixed to the frame (40), the fulcrum being intermediate the ends of the inversion lever (30), an opposite end of the inversion lever from the first-mentioned transfer arm (28) being connected to a second transfer arm (37) that is engaged with the recoil spring (44) for compressing the recoil spring during a firing cycle.

10. The recoil inversion assembly of claim 1, wherein the recoil force transmitting means comprises a second transfer arm (37) connected to the inversion lever (30) for engaging the recoil spring (44).

11. The recoil inversion assembly of claim 1, wherein the recoil force transmitting means comprises a second transfer arm (37) connected to the inversion lever (30) for engaging the recoil spring (44), the spring loaded pivot journal (11) comprising a inversion lever spring (31) captured in the inversion lever for biasing the inversion lever away from the transfer arm (28).

* * * * *